United States Patent [19]

Galow

[11] 4,439,276

[45] Mar. 27, 1984

[54] FILLING ARRANGEMENT FOR COKE OVEN CHAMBERS

[75] Inventor: Manfred Galow, Essen, Fed. Rep. of Germany

[73] Assignees: Bergwerksverband GmbH; Didier Engineering GmbH, both of Essen, Fed. Rep. of Germany

[21] Appl. No.: 384,165

[22] Filed: Jun. 1, 1982

[30] Foreign Application Priority Data

May 30, 1981 [DE] Fed. Rep. of Germany ..... 3121587

[51] Int. Cl.³ ..... C10B 31/02; C10B 31/04

[52] U.S. Cl. ..... 202/239; 202/262; 414/171; 414/200

[58] Field of Search ..... 202/239, 262, 270; 414/171, 200, 201

[56] References Cited

U.S. PATENT DOCUMENTS

| | | | |
|---|---|---|---|
| 3,880,720 | 4/1975 | Wagener et al. | 202/262 |
| 4,042,130 | 8/1977 | Legille et al. | 414/200 |
| 4,151,047 | 4/1979 | Legille et al. | 202/262 |
| 4,344,823 | 8/1982 | Stratmann et al. | 202/270 |

FOREIGN PATENT DOCUMENTS

| | | | |
|---|---|---|---|
| 449089 | 8/1927 | Fed. Rep. of Germany | 202/262 |
| 2831372 | 2/1979 | Fed. Rep. of Germany | 202/262 |
| 1276808 | 6/1972 | United Kingdom | 202/262 |
| 253740 | 4/1970 | U.S.S.R. | 202/262 |

*Primary Examiner*—Bradley Garris
*Attorney, Agent, or Firm*—Michael J. Striker

[57] ABSTRACT

An arrangement for filling at least one coke oven chamber has a transport device arranged to transport coal, a chute member located under the transport device to guide coal to a filling opening of the coke oven chamber, at least one closing member arranged between the chute member and the filling opening of the coke oven chamber, and a sliding plate moveable in a housing above the chute member between open and closed positions, wherein the sliding plate and the housing in its region in which the sliding plate is in its open position are inclined toward a horizontal.

6 Claims, 3 Drawing Figures

FILLING ARRANGEMENT FOR COKE OVEN CHAMBERS

BACKGROUND OF THE INVENTION

The present invention relates to a filling arrangement for a coke oven chamber.

A known filling arrangement has a chute member through which coal travels from a transporting device into a filling opening of an oven chamber, and a closing member is provided between the transporting device and the filling opening. The closing member is formed as a cone arranged in the filling opening. When the conical closing member is in its closed position in the opening the coal has a tendency to harden. In the event that the transporting device is a chain conveyor, its vibrations transmitted to the chute member further increase this tendency. As a result of the hardening of the coal column, the column does not fall by itself during opening of the closing member but must be dislocated. This is however a difficult procedure. When a sliding plate is provided on the chute, it prevents formation of a very high coal column in the chute. The sliding plate, however, also leads to clogging. It takes along coal particles or coal dust during each displacement from the closed position to the open position, so that they clog the housing or the guide of the sliding plate. Elimination of the clogging is very difficult.

SUMMARY OF THE INVENTION

Accordingly, it is an object of the present invention to provide an arrangement for filling coke oven chambers, which avoids the disadvantages of the prior art.

More particularly, it is an object of the present invention to provide an arrangement for filling coke oven chambers which prevents clogging.

In keeping with these objects and with others which will become apparent hereinafter, one feature of the present invention resides, briefly stated, in a filling arrangement having transport means arranged to transport coal, a chute member arranged under the transport means to guide coal to a filling opening, and closure means located above the chute member, wherein the closure means includes a housing and a sliding member moveable in the housing, the sliding member and the housing region in which the sliding member is in its open position are inclined to a horizontal.

Since the sliding plate is inclined closely under the transport means a high coal column is not formed in the closed position of the sliding plate on the latter. Residual coal on the sliding plate is lower at its one end than at its other end, so that also because of this no hardening can take place. Because of the inclined position of the housing bottom, it is guaranteed that the coal particles which are taken along during opening of the sliding plate slide on the inclined bottom and do not clog the housing.

DESCRIPTION OF THE PREFERRED EMBODIMENTS

Figure 1:
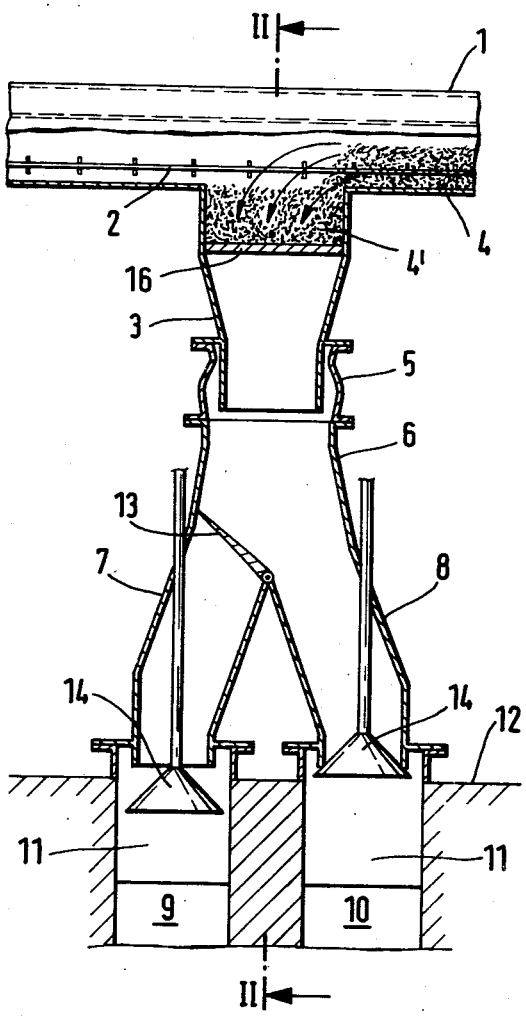
FIG. 1 is a view showing a filling arrangement for two coke oven chambers, in accordance with the present invention.
Figure 2:
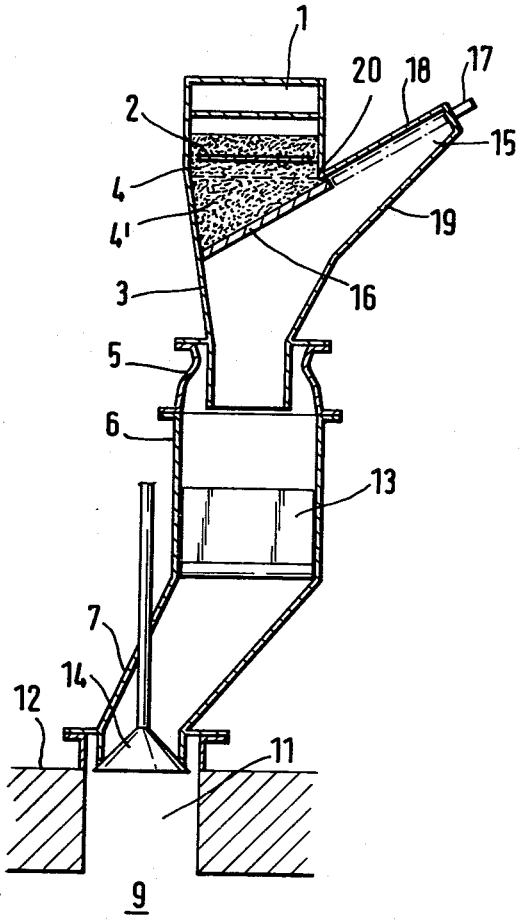
FIG. 2 is a view showing the filling arrangement of FIG. 1 in a section taken along the line II—II in FIG. 1.

A filling arrangement in accordance with the present invention has a chain conveyer 1 with a conveying chain 2. Several outlet chutes 3 are arranged on the chain conveyer 1, of which only one chute is shown in FIGS. 1 and 2.

The conveying chain 2 transports coal 4, particularly preheated coal, to the outlet chute 3. The outlet chute 3 is connected via a compensator 5 with a distributing chute 6. The distributing chute 6 has one branch 7 arranged on an oven chamber 9, and another branch 8 arranged on an oven chamber 10. Filling openings of the oven chambers 9 and 10 are identified by reference numerals 11 and an oven top is identified by reference numeral 12. A distributing flap 13 is arranged in the distributing chute 6 for distributing the coal 4 to the branches 7 and 8. The branches 7 and 8 have conical closing members 14 provided near the filling openings 11.

A housing 15 is formed on the outlet chute 3. A sliding plate 16 is guided in the housing 15. The sliding plate 16 is shown in the drawing in its closed position. With the aid of an actuating part 17 this sliding plate 16 can be displaced to its open position shown in broken lines in FIG. 2. The sliding plate 16 is guided in the housing 15 at an angle relative to a horizontal. It is arranged respectively in inclined position, as can be seen in FIG. 2.

The housing 15 has a top part 18 which extends at the same angle to the horizontal at which the sliding plate 16 extends. The sliding plate 16 displaces closely below the top part 18. The housing 15 is provided with a closed bottom part 19. The bottom part 19 is inclined to a horizontal at an angle which is greater than the angle of inclination of the top part 18. The inclination of the bottom 19 is selected so that coal or coal dust from the outlet chute 3 slides over the bottom part 19. The bottom part 19 transits into the outlet chute 3 with an obtuse angle.

The top part 18 extends in its transition 20 to the chain conveyer 1 at an acute angle. The transition 20 is formed so that it is located as close as possible to the conveyer chain 2. Because of this construction, it is provided that the height of a coal layer 4' between the conveying chain 2 and the closed sliding plate 16 near the transition 20 is lower. At the location opposite to the transition 20, the coal layer 4' with the closed sliding plate 16 is higher in correspondence with the inclination of the sliding plate 16.

The above described arrangement operates in the following manner:

When the sliding plate 16 is closed, for example when other than shown outlet chutes must be filled, the coal layer 4' is located on the sliding plate. When the sliding plate 16 is displaced by the actuating part 17 into the housing 15, the coal layer 4' is released. Because of the small height of the coal layer 4', it breaks and falls through the outlet chute 3 in the oven chambers 9 and 10 in dependence upon the position of the distributing flap 13. Coal 4 additionally supplied from the conveyer chain 2 travels thereby unobjectionably in the respective oven chamber 9 or 10. The breakage of the coal 4 is made easier because the coal layer 4' is considerably lower in the vicinity of the transition 20 than at a location opposite to the transition 20. Because of this no continuous clogging in the space above the closed sliding plate 16 can take place. Possible deposits release because the coal layer 4' in the vicinity of the transition 20 has a smaller weight than the coal layer 4' in the region spaced from the transition 20.

When the sliding plate 16 moves to its open position the coal particles are taken along positively into the housing 15 under the top part 18, as long as they are not stripped in the transition 20. These coal particles also cannot lead to clogging inasmuch as they fall during the next closing of the sliding plate 16 along the inclined bottom part 19 and slide from the latter through the outlet chute 3 into the distributing chute 6.

The sliding plate 16 is arranged so that in its closed position it prevents lateral tricking of coal 4 into the distributing chute 6. Respective strips can be arranged here in addition.

Figure 3:
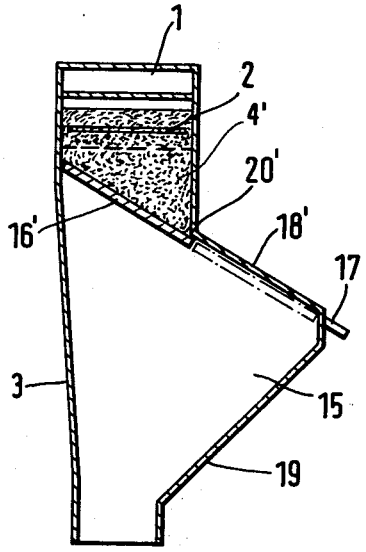
FIG. 3 is a view substantially corresponding to the view of FIG. 2 but showing another embodiment of the invention.

FIG. 3 shows a further embodiment of the invention. As can be seen from FIG. 2, the top part 18 of the housing 15 is arranged in the transition 20 at an acute angle relative to the conveyer band. The same is true with respect to the sliding plate 16. In the filling arrangement shown in FIG. 3, a top part 18' of a housing 15 is arranged at a transition 20' at an obtuse angle relative to a conveyer band 2. The same is true with respect to a sliding plate 16' of the arrangement shown in FIG. 3. The coal layer 4' has a maximum height in the region of the transition 20' and a minimal height in the region opposite to the transition 20'.

It is will be understood that each of the elements described above, or two or more together, may also find a useful application in other types of constructions differing from the types described above.

While the invention has been illustrated and described as embodied in a filling arrangement for coke oven chambers, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An arrangement for filling at least one coke oven chamber having a filling opening, comprising transport means arranged to transport coal;

a chute member arranged under said transport means to guide coal to a filling opening of a coke oven chamber;

at least one closing member arranged between said chute member and the filling opening of the coke oven chamber; and closure means located in an upper portion of said chute member and including a housing formed laterally on and of one piece with said chute member and a sliding plate movable in an upper portion of said chute member and closely under said transport means, into one region of said housing so as to assume an open position in which said sliding plate releases coal into said chute member and into another region of said housing so as to assume a closing position in which said sliding plate prevents coal from entering said chute member and only a small coal layer can lie on said sliding plate, said housing having a bottom part, and said sliding plate and said bottom part of said housing in said one region being inclined relative to the horizontal, so that said sliding plate is inclined relative to the horizontal at a predetermined angle, whereas said bottom part of said housing is inclined relative to the horizontal at an angle exceeding the angle of inclination of said sliding plate.

2. An arrangement as defined in claim 1, wherein said housing has a top part extending parallel to said sliding plate and non-parallel to said bottom part.

3. An arrangement as defined in claim 2, wherein said top part of said housing is arranged so that an obtuse-angled transition is formed between said top part and the horizontal.

4. An arrangement as defined in claim 2, wherein said top part of said housing is arranged so that an acute-angled transition is formed between said top part and the horizontal.

5. An arrangement as defined in claim 4, wherein said transition is provided adjacent to said transport means.

6. An arrangement as defined in claim 1, wherein said housing has a top part, said sliding plate being moveable closely below said top part of said housing.

* * * * *